US011589714B2

(12) United States Patent
Weiser

(10) Patent No.: US 11,589,714 B2
(45) Date of Patent: Feb. 28, 2023

(54) FREESTANDING CHILD BATH SAFETY DEVICE

(71) Applicant: Joshua Weiser, Plymouth Meeting, PA (US)

(72) Inventor: Joshua Weiser, Plymouth Meeting, PA (US)

( * ) Notice: Subject to any disclaimer, the term of this patent is extended or adjusted under 35 U.S.C. 154(b) by 137 days.

(21) Appl. No.: 17/184,794

(22) Filed: Feb. 25, 2021

(65) Prior Publication Data

US 2021/0259476 A1 Aug. 26, 2021

Related U.S. Application Data

(60) Provisional application No. 62/981,092, filed on Feb. 25, 2020.

(51) Int. Cl.
*A47K 3/00* (2006.01)
*A47K 3/024* (2006.01)

(52) U.S. Cl.
CPC ..... *A47K 3/001* (2013.01); *A47K 3/024* (2013.01)

(58) Field of Classification Search
CPC ..... A63H 23/005; A63H 23/10; A47K 3/024; A47K 3/034
USPC ..... 4/567
See application file for complete search history.

(56) References Cited

U.S. PATENT DOCUMENTS 5,261,603 A * 11/1993 Driska ..... A63H 3/003 239/289
2013/0061384 A1* 3/2013 Robertson ..... E04H 4/14 4/496
2018/0085679 A1* 3/2018 Welch ..... A63H 29/14

* cited by examiner

*Primary Examiner* — Lauren A Crane
(74) *Attorney, Agent, or Firm* — Lombard & Geliebter LLP; Antonio Papageorgiou

(57) ABSTRACT

A device for bathing children is provided that includes: a hollow body; a plurality of height adjustable legs extending outward from the body; a funnel shaped insert in the hollow body at the distal end thereof, the funnel shaped insert having an opening to receive a vertical flow of a water and an exit extending outward from a bottom of the funnel shaped insert in an orientation that redirects the vertical flow of the water; a tubular channel disposed within the hollow body and coupled at a first end to the exit of the funnel shaped insert and extending toward the proximal end of the hollow body; and a spout rotatably coupled to the tubular channel at a proximal end opposite the first end.

20 Claims, 13 Drawing Sheets

FREESTANDING CHILD BATH SAFETY DEVICE

BACKGROUND OF THE INVENTION

This application relates to articles of manufacture for use in bathing children safely.

Many products exist for bathing children, including several character shaped products that fit over the spout of a bath. These and other bath toys, however, may be unsafe, insofar as the child is provided access to the faucet and drain controls. These products may further have characteristics that children find overwhelming, for example, because of their size or failure to regulate the flow of water exiting the spout of the bath. Accordingly, there is a need for products for use by children or parents during the bath time that are safer and more fun for the child to use.

SUMMARY OF THE INVENTION

A device for bathing children is provided that includes: a hollow body having a proximal end and a distal end opposite the proximal end; a plurality of height adjustable legs extending outward from the body; a funnel shaped insert in the hollow body at the distal end thereof, the funnel shaped insert having an opening to receive a vertical flow of a water and an exit extending outward from a bottom of the funnel shaped insert in an orientation that redirects the vertical flow of the water; a tubular channel disposed within the hollow body and coupled at a first end to the exit of the funnel shaped insert and extending toward the proximal end of the hollow body; and a spout rotatably coupled to the tubular channel at a proximal end opposite the first end.

In one embodiment, the body has a shape resembling anatomical features of an animal.

In one embodiment, the spout is rotatable 360-degree relative to the hollow body.

In one embodiment, the spout has a bend therein.

In one embodiment, at least one of the plurality of height adjustable legs includes an elongated threaded leg extension having helical threading on an external surface thereof.

In one embodiment, at least one of the plurality of height adjustable legs comprises a tubular holder having helical threads corresponding to the helical threads of the elongated threaded leg extension on an interior surface of the tubular holder, and wherein the tubular holder is fixedly coupled to the hollow body, the at least one of the plurality of height adjustable legs adjustable by rotating the elongated threaded leg extension relative to the tubular holder.

In one embodiment, the at least one of the plurality of height adjustable legs comprises a suction cup pivotally coupled to the elongated threaded leg extension.

In one embodiment, the elongated threaded leg extension has incremental markings at a bottom thereof to display a water level from a bottom of the adjustable leg.

In one embodiment, the at least one of the plurality of height adjustable legs is other than plumb and wherein the incremental markings are at an angle.

In one embodiment, the markings are at an angle between 25° and 60°.

In one embodiment, the tubular channel is disposed horizontally within the hollow body.

In one embodiment, the tubular channel disposed within the hollow body to have a slope between 1.5% and 12.5%.

In one embodiment, the tubular channel disposed within the hollow body has a length of 14" to 17".

In one embodiment, a linear slope from a top of the funnel shaped insert to the spout is between 14.6% and 25.6%.

In one embodiment, the device has a plurality of front leg and wherein the plurality of front legs are splayed laterally to provide a footwell providing clearance of between 4.5" and 11".

In one embodiment, the device has a plurality of articulating rear legs.

In one embodiment, the articulating legs include at least one spherical joint with a rail thereon and a leg portion with a slotted spherical socket that receives the spherical joint in a pivoting relationship.

Other aspects will be apparent from the disclosure herein.

DETAILED DESCRIPTION OF THE INVENTION

Figure 1A:
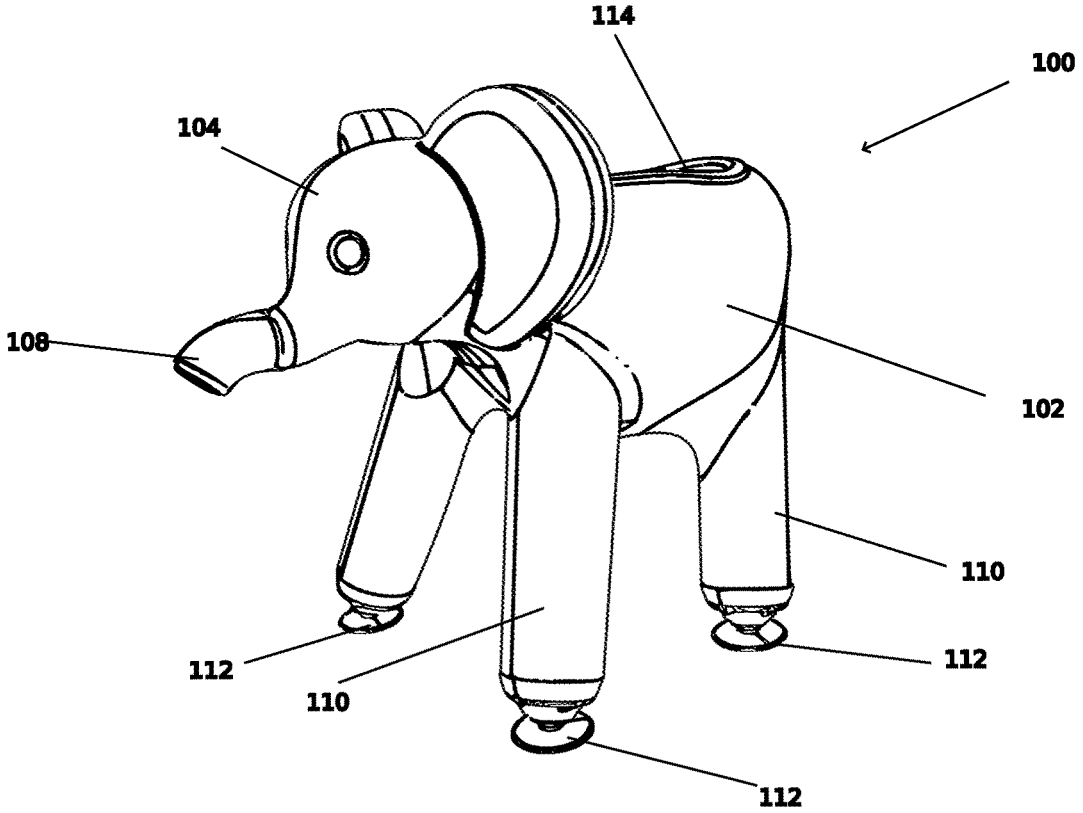
FIG. 1A-1B are perspective views depicting the front, side, and top of the device according to at least one embodiment of the devices disclosed herein.

The present application generally provides a product or products to implement and facilitate a new, cleaner, and safer approach to bathing young children. This product was created with intent to limit the potential for infant drowning, water related injuries, and other unsanitary washing practices.

In at least one aspect, a free-standing, height adjustable, infant to toddler (9 months-3 years) bath safety device is provided, that aids parents in safely bathing their children, by eliminating or otherwise ameliorating potential infant drowning and other traditional hazards associated with water related injuries.

The device can be configured by incorporating features on a figurine that resemble certain familiar anatomical features of an animal or character to make it more aesthetically pleasing to children, such as an elephant or rhinoceros. The device preferably features a 360-degree swivel water exit section, with a unique pitch (degree of slope) that allows for multiple options to direct water flow onto the child below eye-level and directly onto the child's torso. When in use, the device provides a continuous flow of clean, temperature-controlled water, while allowing for soiled, soapy water to drain out of the tub. The device also allows parents to have both hands on their child at all times of bathing process. That is, the device moves the flow of water from the bath's spout closer to the infant so that the parent does not need to reach for water from the bath's spout with one hand. The device is preferably made with elastomeric materials, such as plastic or thermoplastic rubber, that withstand relatively high temperatures (e.g., 100 degrees C.) for easy cleaning.

In at least one embodiment, the device is adjustable so that the height of figurine may be manipulated by screwing in and/or out adjustable height legs, if needed to accommodate the height of child so that the water is directed below the level of the child's chin. Users may place the device (animal figurine) directly under the waterspout of the bath faucet while the drain is open, thereby limiting the risk of drowning. The user may further ensure all four legs of figurine are affixed firmly to bath floor, for example with suction at each leg, followed by turning on the bath's faucet, and once water is flowing through device correctly, adjust temperature, and test water at the point of exit. The child may then be placed in front of the water exiting the device in seated position, with the child's legs extended straight under figurine's body. The device is configured so that water flows directly from the bath's spout, into the rear of the figurine, and onto or closer to the child at a level below the child's chin. This configuration beneficially presents a barrier to the child with respect to accessing the bath's spout and drain, so that the child does not accidentally cause the bath fill or change the water temperature/flow. Water flow is converted by the device from a vertical to horizontal flow approximately a foot away from faucet, to provide children with a continual flow of clean, temperature-controlled water. The device is meant to be used with the drain fully open through entirety of bathing process to eliminate the chance of injury.

The device is preferably a free-standing, early childhood transitional bath accessory that is placed under the bath faucet in conjunction with an open drain and under parental supervision. Preferably, the device dimensions are based on pediatric infant-to-toddler growth charts specifically for children 9 to 36 months of age. The device is formed as a friendly and familiar animal figurine that provides a continuous stream of clean, temperature-controlled water onto the torso of the child. Preferably, the device has a recessed and/or slanted rear section (to account for potential tub drain levers/controls) and forward-angled legs that move both upwards and backward to accommodate both the growth of the child and standard tub slopes/faucet configurations.

The device preferably has legs spaced apart laterally (side to side) to provide footwells for prompted foot placement for children 9 to 18 months-old behind the front legs and additional footwells behind the back legs built for 18 months to 3-year-olds. The device is preferably held in place by extra-large, maneuverable suction cups to conform to most standard tub slopes. The leg adjustments may have markings at the 1- through 3-inch increments to visually display how much excess water is in the tub. The markings may be orthogonal to the plane of the leg extension or at an angle relative to the leg extension, between 25°-60°, preferably around 33°, or in the same plane of the bath water. This safety feature is in accordance with preventative drowning guidelines set by the American Academy of Pediatrics.

The dimensions of the device may vary, but the length of the device is preferably greater than the average arm length (reach) of a child from 9 to 36 months and will remain consistent with the height adjustments necessary based on the growth of the child. This feature obstructs the child's reach from the hot/cold water handles, potentially injuring themselves on the tub faucet and tampering with the tub drain.

The device preferably has a 360-degree swivel spout for users to direct water to multiple points along the child's body, providing the flow of water easy access to the front, side, and rear of the child for easy bathing. The 180-degree movement creates multiple options for hazard-free hair washing. The device's sturdy body and preferably soft-exterior coating may be formulated with anti-bacterial and mold resistant materials. The materials may be chosen to provide additional protection, comfort, and easy cleaning of the accessory. The engaging nature of the figurine, the continuous stream of clean warm water, precise dimensions, and placement of the footwells provide the necessary combination of features to address a specific, or multiple bath time safety concerns in comparison to other marketed bath positioning and safety products.

Figure 1B:
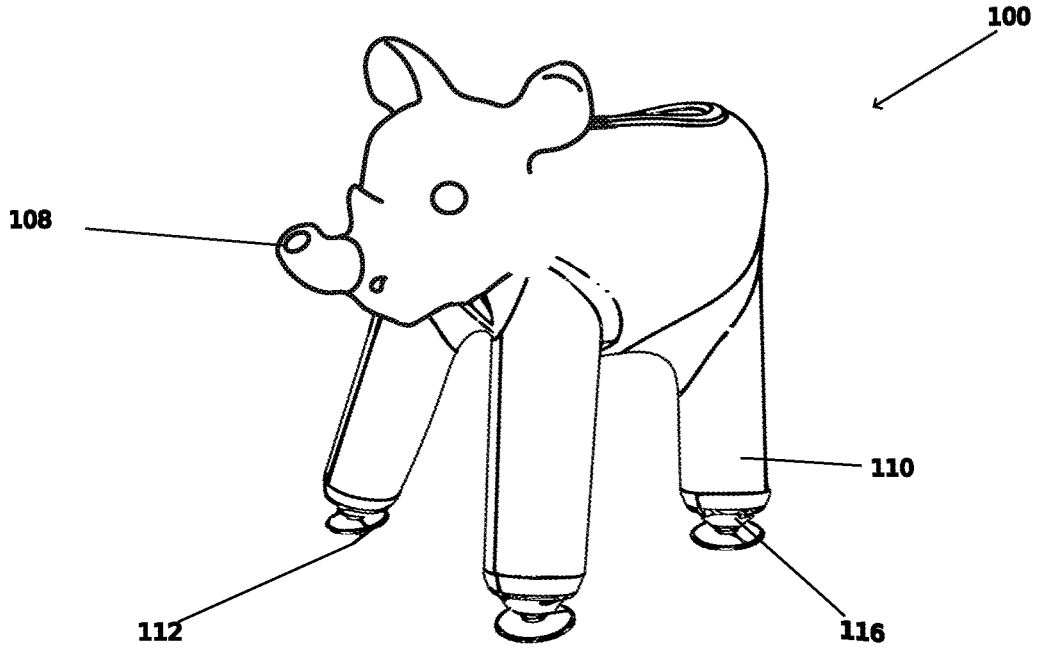
Figure 2:
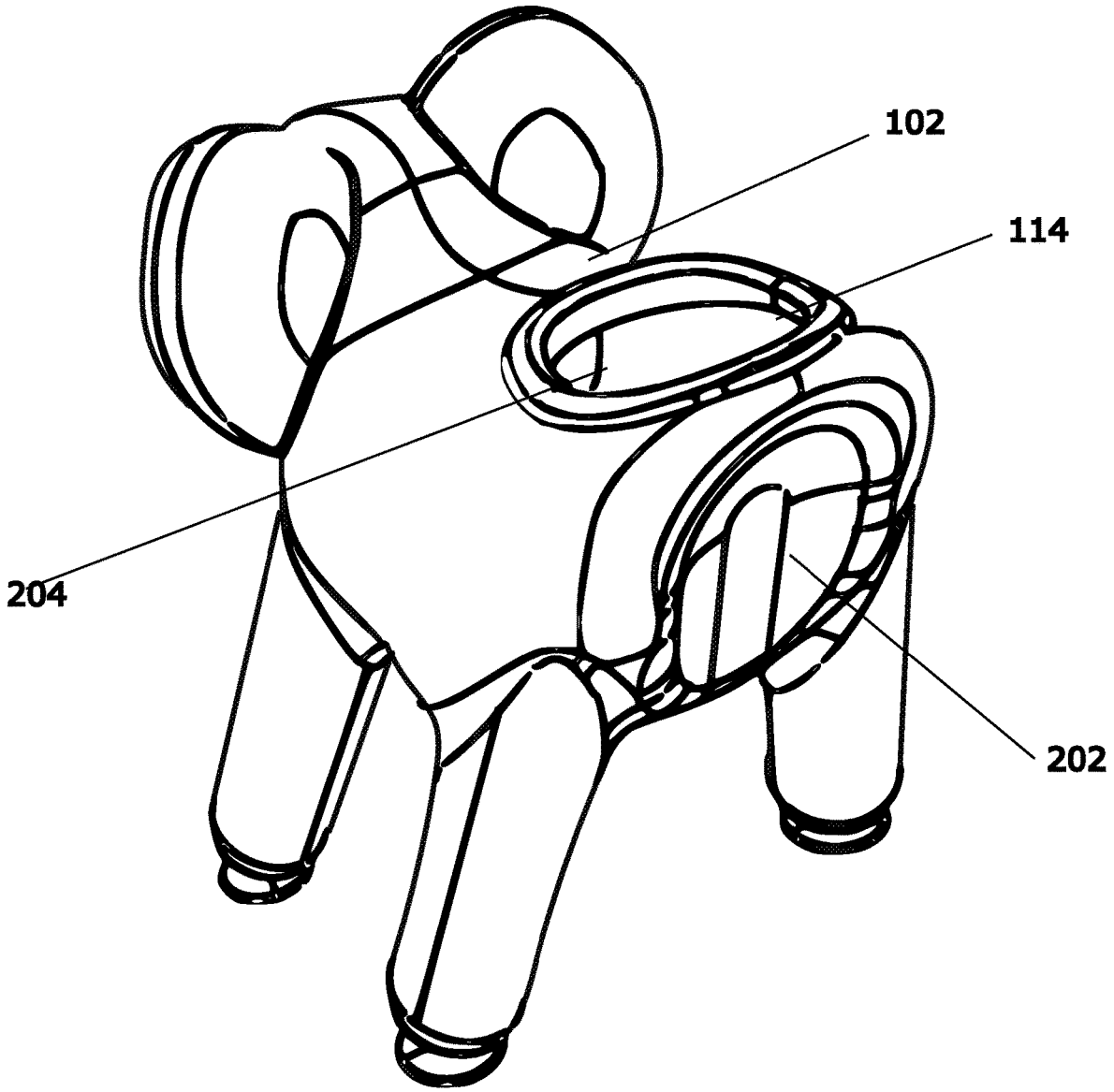
FIG. 2 is a perspective view depicting the top, side, and rear of the device according to at least one embodiment of the devices disclosed herein.
Figure 3A:
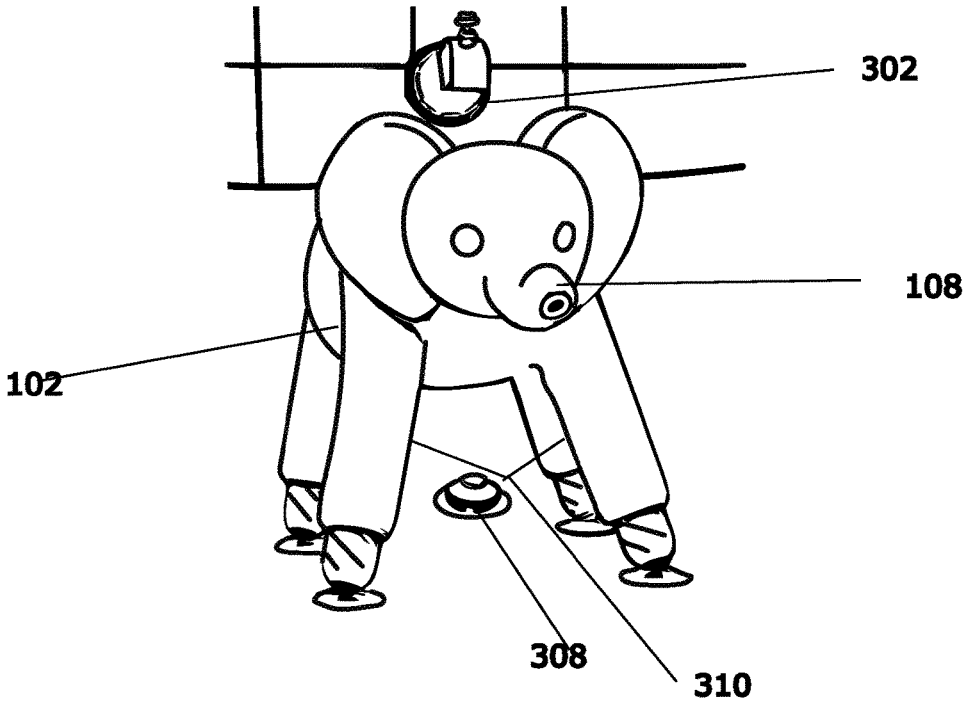
FIGS. 3A-3B are front and side views depicting the device according to at least one embodiment of the devices disclosed herein.
Figure 3B:
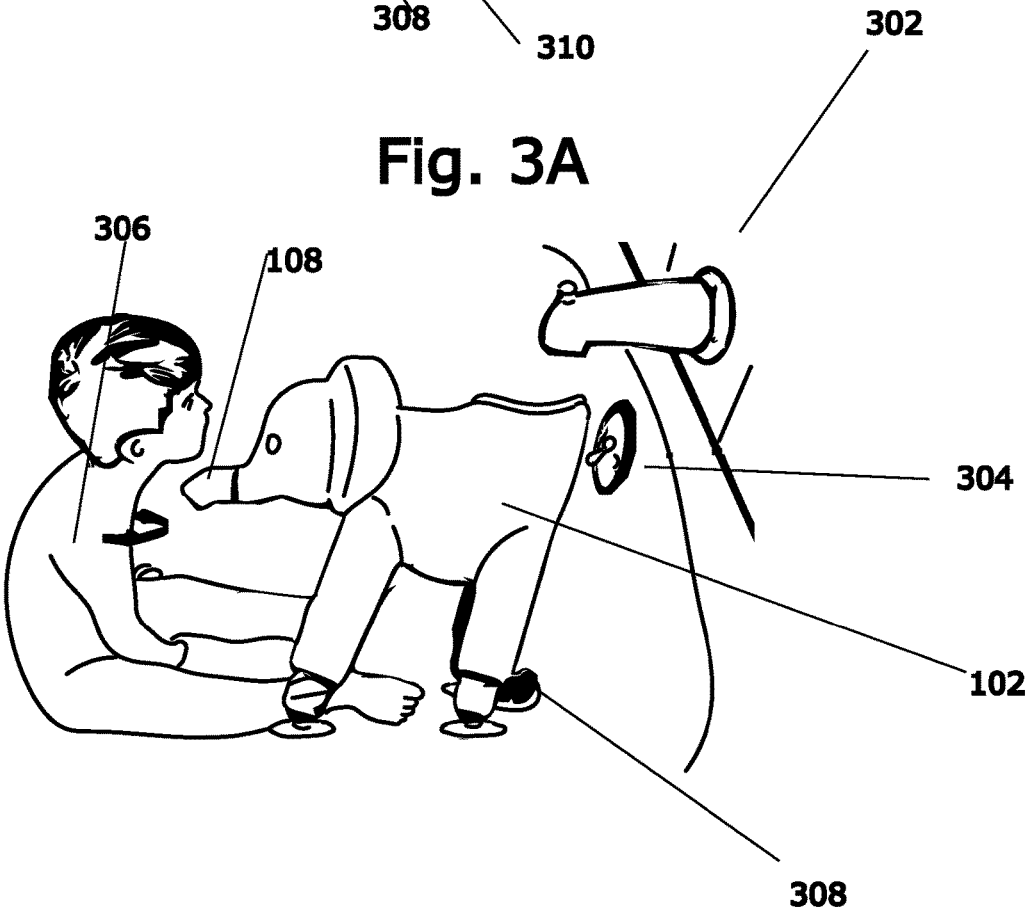

Referring now to the drawings, FIGS. 1A and 1B depict the bath safety device 100 according to at least one embodiment as animal figurines. The figurine when used is placed directly under the bath faucet's spout while overtop and in conjunction with fully open bath drain, as shown in FIGS. 3A-3B. The device 100 generally includes a hollow figurine body 102 with a funnel shaped entry/insert 114 at a distal end within the hollow body 102 and a spout 108 at the proximal end, opposite the distal end. The device 100 further includes a plurality of legs 100 extending outward from the body 102. At the end of each leg 110, the device 100 has at least one suction cup 112 or other means for attaching the device to the tube. Preferably, the device 100 includes adjustable height leg assemblies 116 at one or more of the legs 110, which allow the height and trajectory of the spout 108 to be adjusted. As shown in FIG. 2, the funnel shaped entry 114 includes an exit 204 proximally located and oriented in a direction essentially horizontal relative to the flow of the vertical water (e.g., 80-110 degrees relative to the water flow) into the entry 114 and in a forward direction. Moreover, the distal end of the body 102 includes a recess 202 to accommodate drain controls. This recess may have a depth of about 0.5"-4.0", preferably at around 1.8".

The figurine may be made from a variety of materials, but preferably from elastomeric materials and or thermoplastic rubber. The bath device is shown as an elephant but can also be provided in the shape of a rhino, bear, lion, and other anatomically similar forms.

Referring to FIGS. 3A-3B, the device 100 is generally placed in the tub below the bath spout 302 so that water from the spout 302 flows into entry 114 and exits from spout 108. As can be seen, the legs 110 are splayed laterally to form a footwell 310. Moreover, the front to rear dimension of the device 100 forms a barrier between the child 306 and the bath controls (drain 304, 308) and spout 302. The dimensions of the device may vary to achieve the desired functions and to accommodate different size children. Overall, dimensions are preferably (L×W×H)=16"×10"×13", but may be +/−50% for varying sized children. Footwell spacing at the bottom of the legs may be between 4.5"-11", preferably around 6.5".

Figure 4:
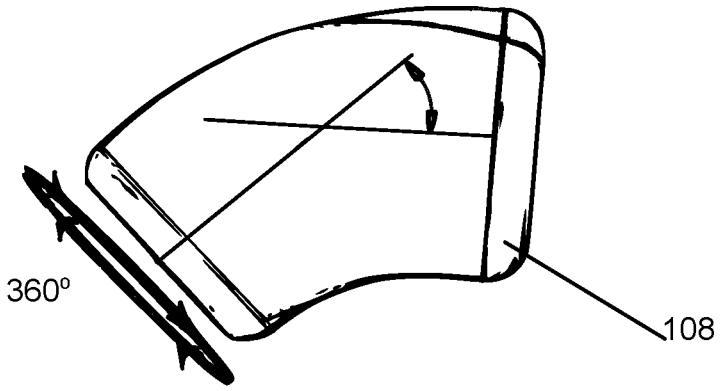
FIG. 4 is a side view of a spout for use with the device according to at least one embodiment of the devices disclosed herein.
Figure 5:
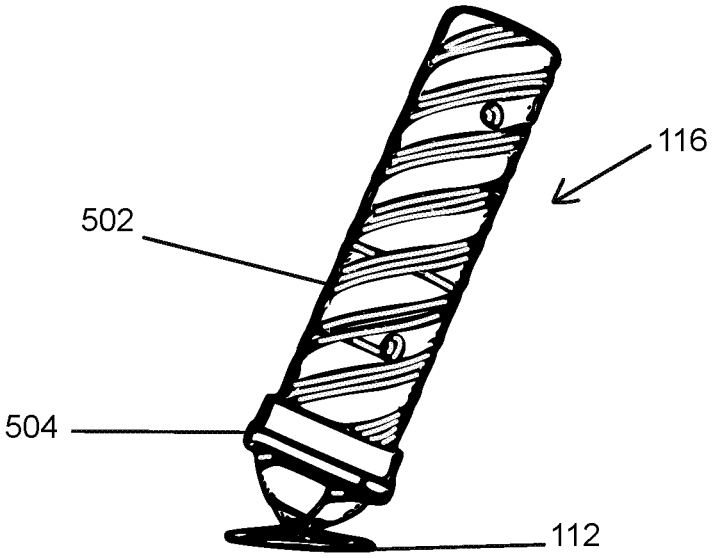
FIGS. 5 and 8 are a side view and a perspective view an adjustable height leg assembly according to at least one embodiment of the devices disclosed herein.
Figure 6:
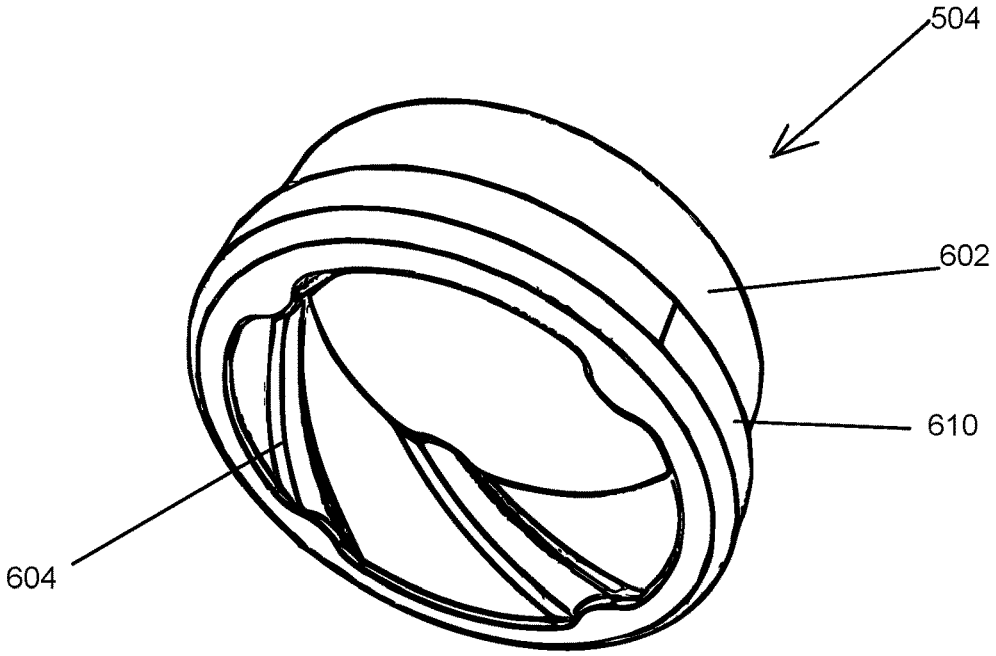
FIGS. 6-7 are perspective views of a leg retainer portion of the adjustable height leg assembly according to at least one embodiment of the devices disclosed herein.
Figure 7:
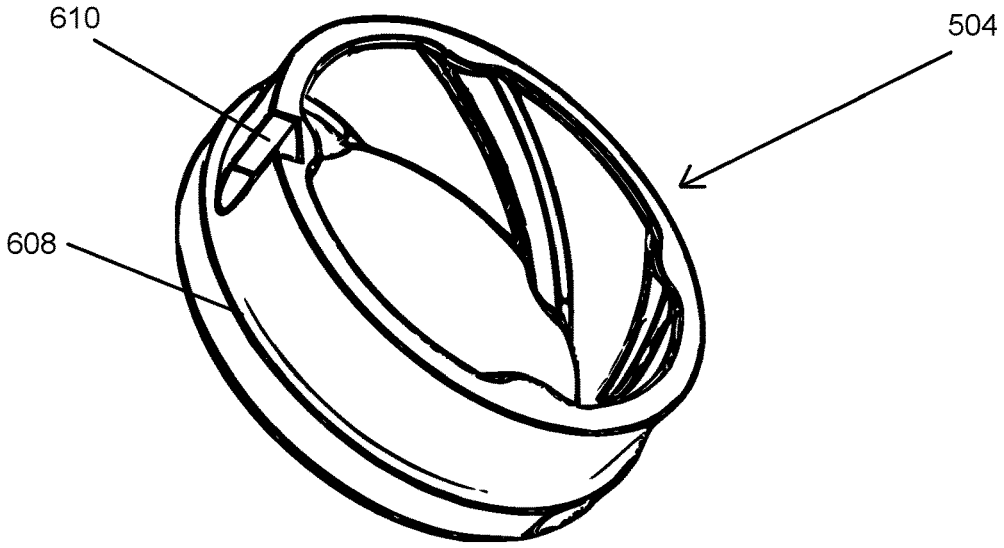
Figure 8:
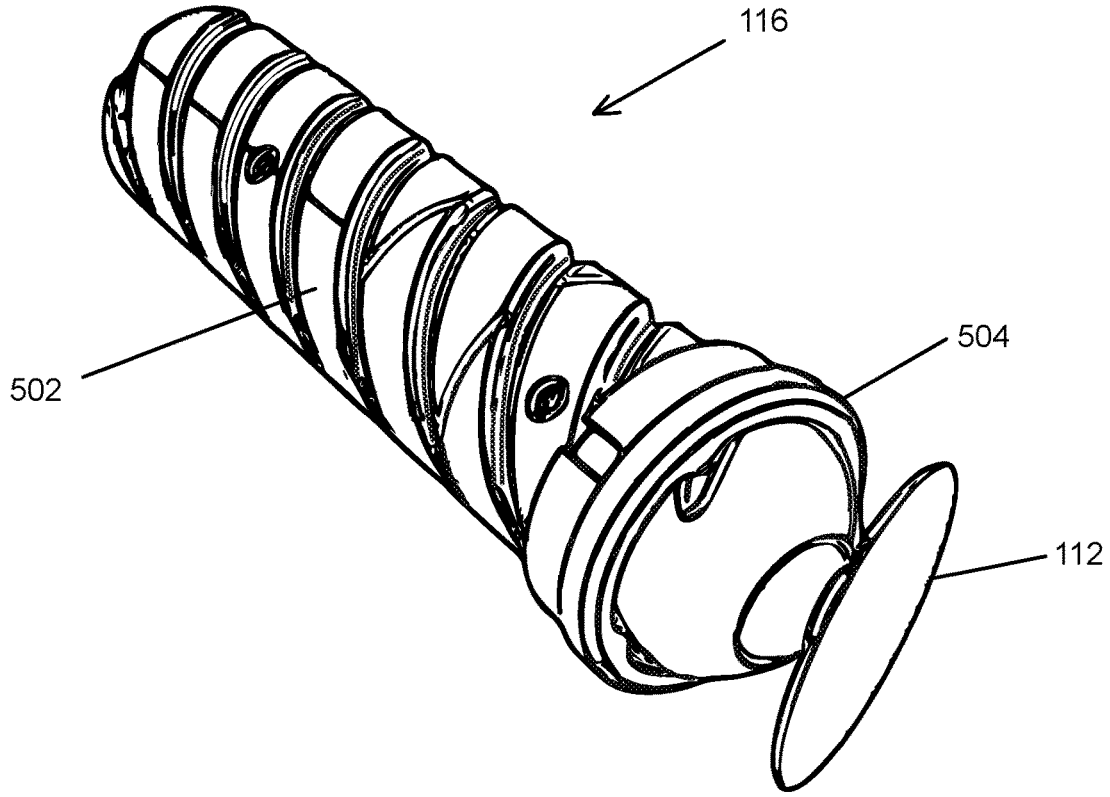
Figure 9:
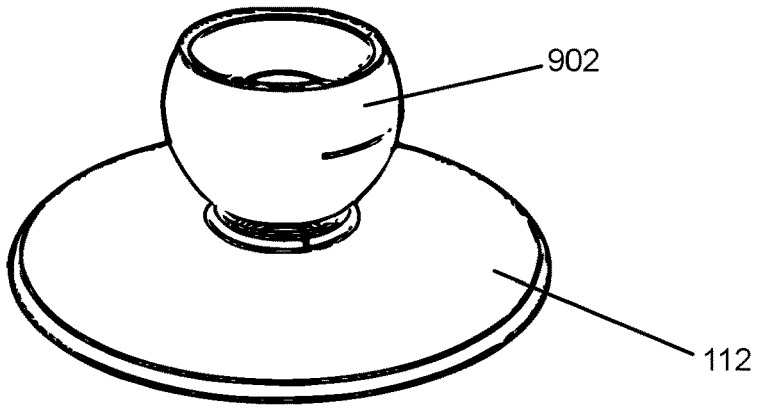
FIG. 9 is a perspective view of a suction cup of the adjustable height leg assembly according to at least one embodiment of the devices disclosed herein.

FIG. 4 depicts a side view of the spout 108, which is preferably a tubular structure with at least one change in direction. That is, the structure has in incoming opening and an outgoing opening, at opposing ends, and the axis orthogonal to each opening is other than 0 degrees relative to each other, preferably 20-60 degrees and more preferably 45 degrees. Moreover, the spout 108 is preferably rotatably coupled to the device 100 so that it has a full 360 degrees of rotational freedom of movement. Preferably, the spout 108 is made from a softer and more malleable material comparison to body. The spout 108 can have an interior aperture (such as or resembling a mouth or nose) or exterior of apparatus body (such as or resembling a trunk or horn). The interior or exterior exit aperture angles are configured for directing flow of water to an appropriate level in conjunction with toddler size and growth rate, as discussed above. The spout 108 also allows water to flow out in an upward and downward direction.

Figure 10:
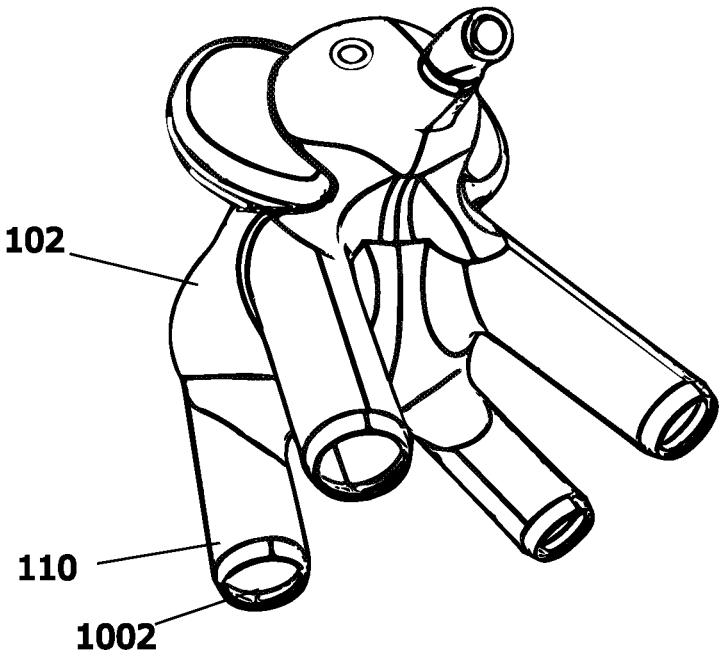
FIG. 10 is a perspective view depicting the bottom, side, and front of the device according to at least one embodiment of the devices disclosed herein.
Figure 11:
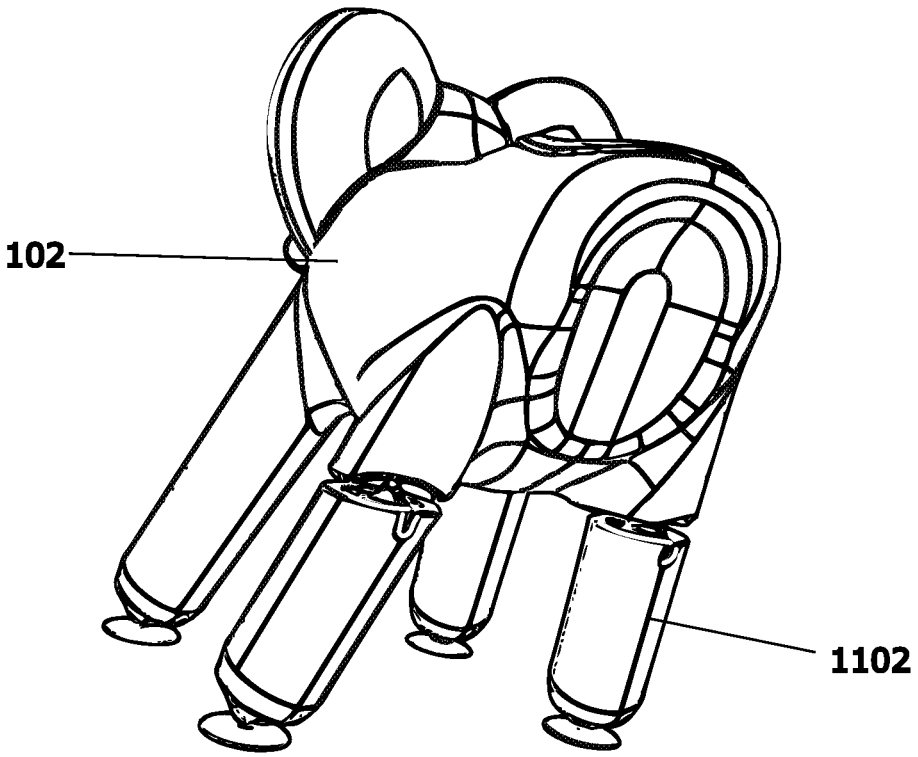
FIGS. 11-15 are various views depicting the device according to at least one embodiment of the devices disclosed herein with articulating rear legs.

Referring to FIGS. 5-10, at least one of the legs 110 includes a leg height adjustment assembly 116. In one embodiment, the assembly 116 includes an elongated threaded leg extension 502 with helical threading on the external surface thereof. The assembly 116 further includes a tubular holder 504 with helical threads 604, on the inside surface of the holder 504, corresponding to the threads on the leg extension 502 such that rotating the extension 502 relative to the holder 504 causes the extension 502 to move upward and downward relative to the holder 504. The holder 504 may be affixed to the body 102 of the device 100, and more particular to a hole 1002 at the end of each leg 110 (as shown in FIG. 10). In this regard, rotation of the leg extension 502 alternatively causes the extension 502 to be extended outward and inward from the leg(s) 110. The holder 504 may include a notch 610 therein that mates with a key in at least one of the legs 110 to prevent rotation of the holder 504 relative to the leg. The holder 504 may be adhered to or otherwise fixedly connected to the body 102/legs 110. In one embodiment, the holder includes a flange 608 between tubular sections 602 and 610, sized such that section 602 may be inserted into the hole 1002 until flange 608 is stopped by the end of leg 100. As discussed herein, the device 100 may be removably affixed to the bathtub with suction cups 112. In one embodiment, the suction cup 112 is hinged to the end of the leg extension with spherical cup 902 that fits into a corresponding spherical recess in the leg extension 502 therewith provide full 360 degree swivel capability.

Figure 12:
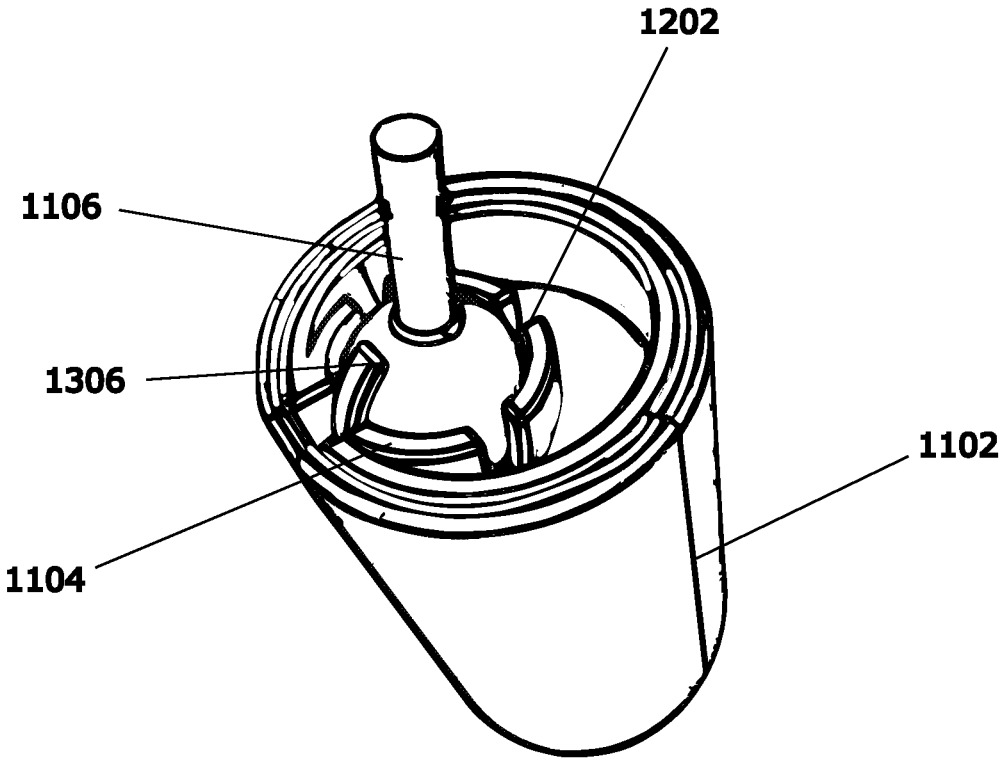
Figure 13A:
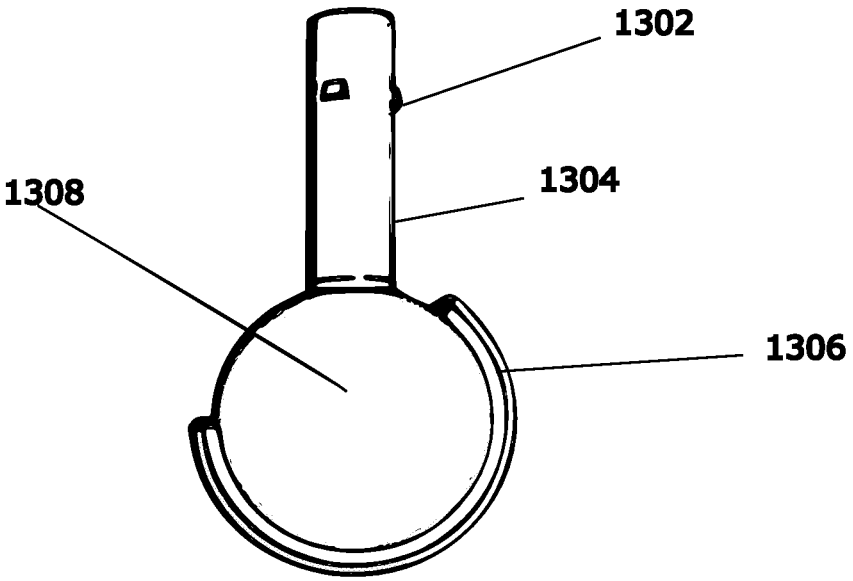
Figure 13B:
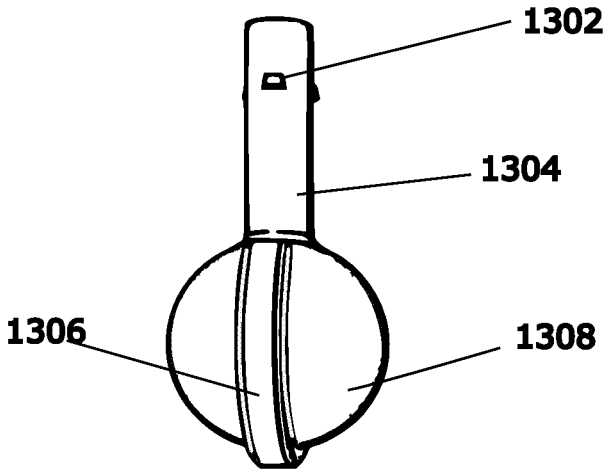
Figure 14:
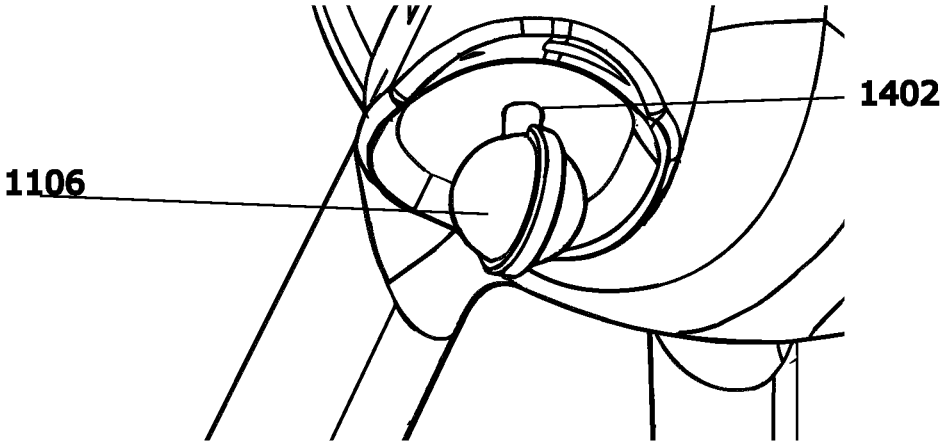
Figure 15:
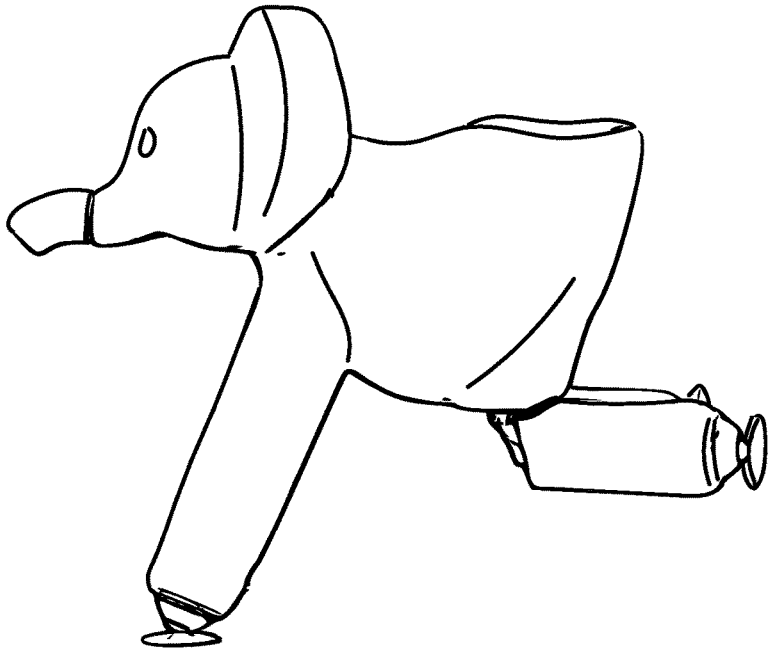

Referring to FIGS. 11-15, the device 100 may include articulating legs 1102. The legs 1102 are preferably able to bend in at least one degree of freedom, preferably at least 90 degrees, as shown in FIG. 15. In one embodiment, the articulating let 1102 includes a socket 1104 that receives a spherical joint 1106, as shown in FIG. 12. The socket 1104 may have a corresponding spherical shape to provide rotational range of movement in the legs 1102. Movement may be restricted to one degree of rotational freedom (front to back) with slots 1202 and corresponding joint rails 1306 that restrict movement in the direction of the rails 1306/slots 1202. The spherical joint 1106 generally includes a spherical portion 1308 with the rail 1306 extending outward therefrom. A post 1304 may further extend outward from the spherical portion 1308, which post fits into an aperture 1402 in the body 102, as shown in FIG. 14. The post 1304 may include barbs 1302 that engage internal structure at the aperture 1402 to retain the joint 1106 therein (FIG. 16A).

Figure 16A:
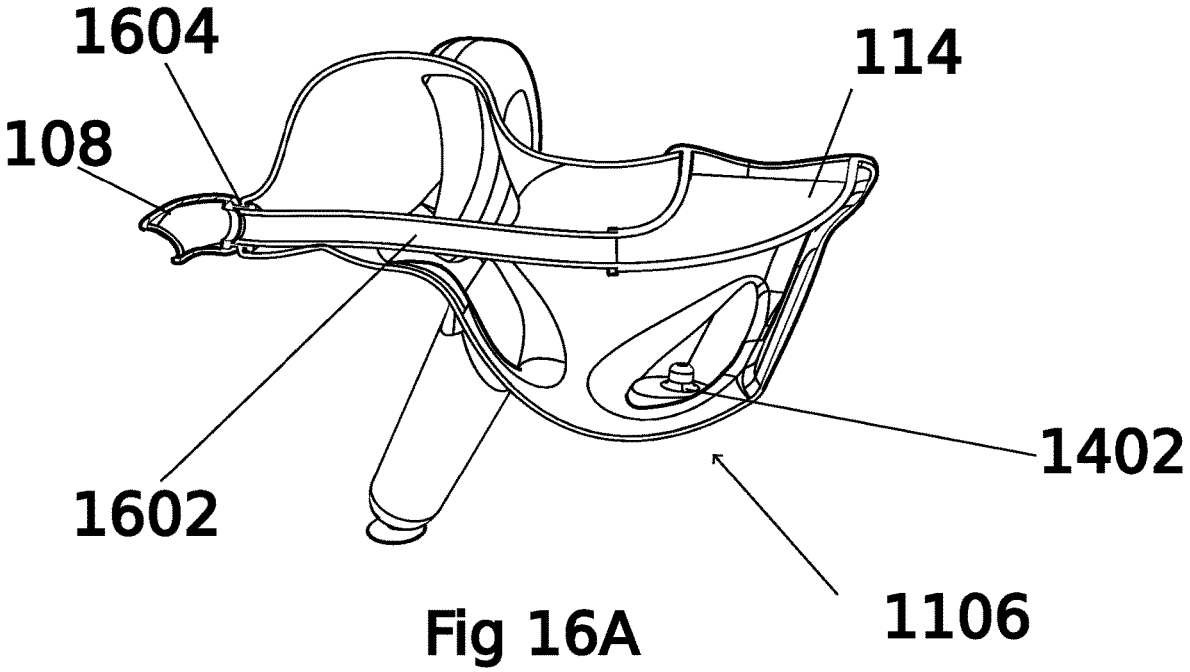
FIGS. 16A-20 are various views depicting the internal components and optional temperature sensor of the device according to at least one embodiment of the devices disclosed herein.
Figure 16B:
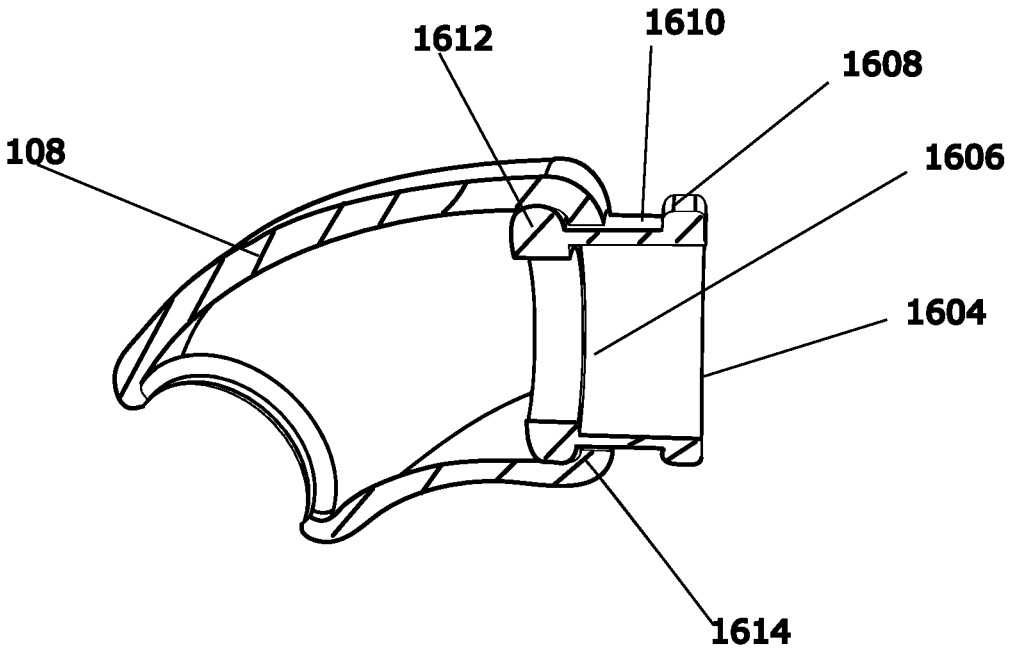

Referring to FIG. 16A, the device 100 includes a single funnel shaped entry point 114 at the rear top of the device 100, connected by tubular interior cavern or channel 1602 to a single front exit point, i.e., the spout 108 and/or intermediate joint 1604. Channel 1602 exit section preferably contains a 360-degree swivel spout 108 directing water in upward or downward direction. The shape of the channel and swivel redirects the water from the bath's spout in a way and at a location that is fun and not overwhelming for children. This may include, for example, reducing the pressure based on the geometry of the system, controlling the temperature, and generally lowering the level/elevation of the outflow from the height of the bath spout to the height of the exit point of the device at spout 108 closer to the level of the child. FIG. 16B depicts the details of the swivel spout 108 assembly according to at least one embodiment. The assembly includes the spout elbow 108 rotatably coupled to an intermediate joint 1604. The intermediate joint 1604 is preferably a cylindrical tubular structure with semi-toroidal ends. These ends generally engage cinched ends 1614 at the spout 108 and body exit point, as shown in FIG. 16A, to prevent the parts from becoming disconnected from each other. The outside dimensions of the interior cavern or channel 1602 match the inside dimensions of the intermediate joint 1604 to provide a leak proof connection. The intermediate joint 1604 may include a circumferential flange 1606 within the inner structure to act as a stop for the channel 1602.

Interior Channel/Swivel Section/Connection

Figure 17:
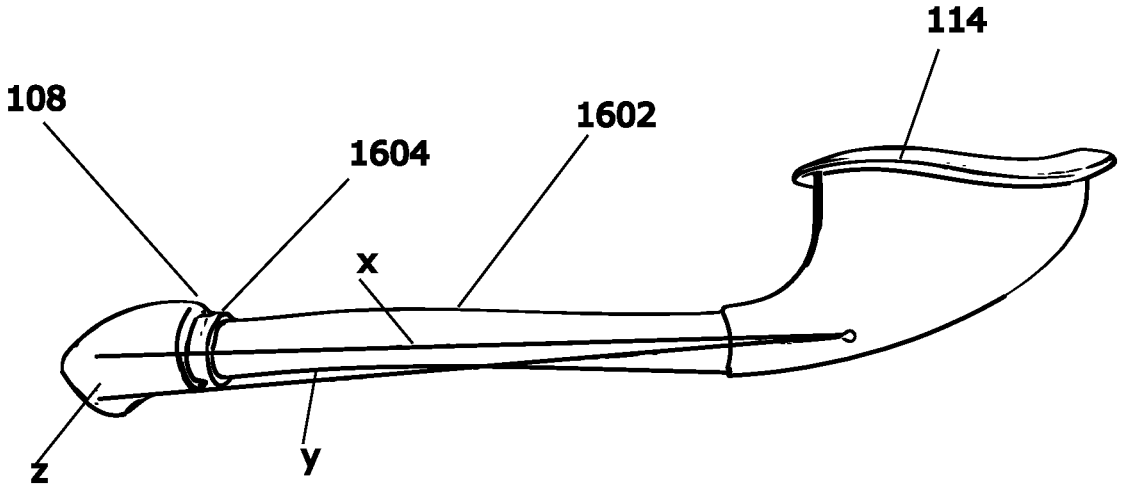
Figure 18:
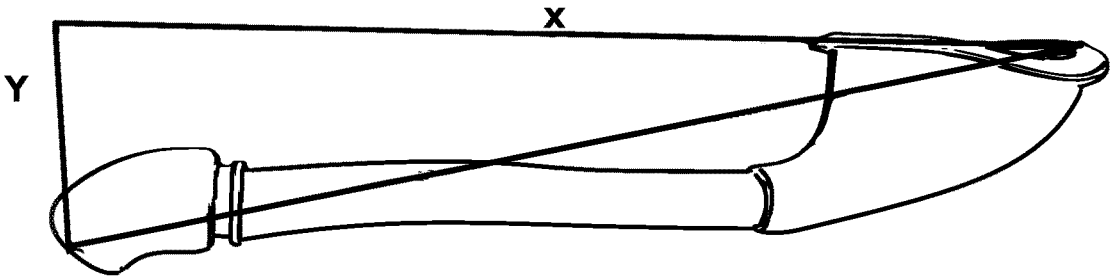

Referring to FIGS. 17-18, the interior channel 1602 diameter opening is in a range from ½" to 1 ½", and preferably about 1". The opening to the funnel may be greater, as shown in the drawings. Water channel 1602 linear slope may a range from between 1.5% to 12.5%, and preferably about 6% on average. Swivel section preferably has a bend in a range from 20° to 60°, and more preferably about 45°. As shown, the channel 1602 is essentially horizontal, which reduces the head or pressure of the flow exiting the batch spout. This reduction is a function of the length of the channel 1602. Preferably, the horizontal length (x) is 9" to 14", or preferably about 11.7 inches. Over the length of the channel 1602, the channel may drop (z) from 0.1" to 1.0", preferably 0.7". From the entry 114, the length (X) may be 14"-17", or preferably 15.145", and the drop (Y) may be 4"-6", or preferably 2.83". Linear slope from top of funnel to the spout may be 14.6%-25.6%, preferably around 19.1%. The internal connections may include O-rings to provide an airtight/leak proof water channel.

Height Adjustment/Dimensions

The device 100 preferably includes adjustment for the height of the channel exit. This may be accomplished with a plurality of adjustable legs, as shown in the drawings. In one embodiment, each of the legs includes an adjustable airtight screw in and out leg extensions. Each leg preferably adjusts 0-6 inches each, preferably 3.5 inches. In this regard, the max dimensions (L×W×H)=16×10×17 inches. The total length of the device may range between 11"-20", preferably around 16.5". Heavy duty suction cups may connect to the legs via a keyhole mount or swivel on the underside of one or more of the screw leg extension footrests. As shown in FIG. 3B, the rear legs have proximal slant. Preferably, this offset is between 1" and 6", preferably around 3". With respect to the articulating legs, the range of movement may be from 95°-120°, preferably around 106°. In this regard, the spout height may be between 7" and 14", preferably at least around 10".

Features

The device according to at least one embodiment will allow for the continual use of clean water to be used on child while bathing, without the need or dangers of excess unhygienic water to keep child warm.

The device according to at least one embodiment will allow water to be transferred from faucet spout, through device, onto child, and then drains out of tub. The child will no longer need to sit in, wash, or potentially swallow dirty or recycled water.

The device according to at least one embodiment has a ten-inch width between legs which allows for child's legs to be positioned directly under figurine prompting child into seated position without the need for a bath seat and associated rigid leg restraints or belts. The child will also no longer be able to easily access drain, as device placement forces child towards center of tub. The length of figurine will preferably position child away from bath faucet and obstruct their ability to tamper with hot and cold bathtub faucet handles, or tub drain. The dimensions allow parent to be able to keep at least one supporting hand on child while washing.

Height adjustment (and narrow depth to rear) embodiment will accommodate for use with variety of different tub shapes and faucet configurations and allows device to grow with child.

Optionally, while rinsing hair the device allows to have child lean forward with head down under spout. Or to turn child around, swivel water exit section upwards 180 degrees or otherwise, while leaning child backwards (keep soap and water away from eyes).

The device is preferably solid and sturdy while suctioned onto the bottom of tub leaving gap above basin so water can drain. Replaceable heavy-duty suction cups may be provided if they wear from water damage. Mold free solid rubber construction allows one to clean by hand or dishwasher. The device in conjunction with open drain ensures that no more than half-inch to an inch of water is present in tub at any given time. Use of device converts turbulent water flow from faucet into a gentler, more focused stream. Easy to install and remove from the tub.

Figure 19:
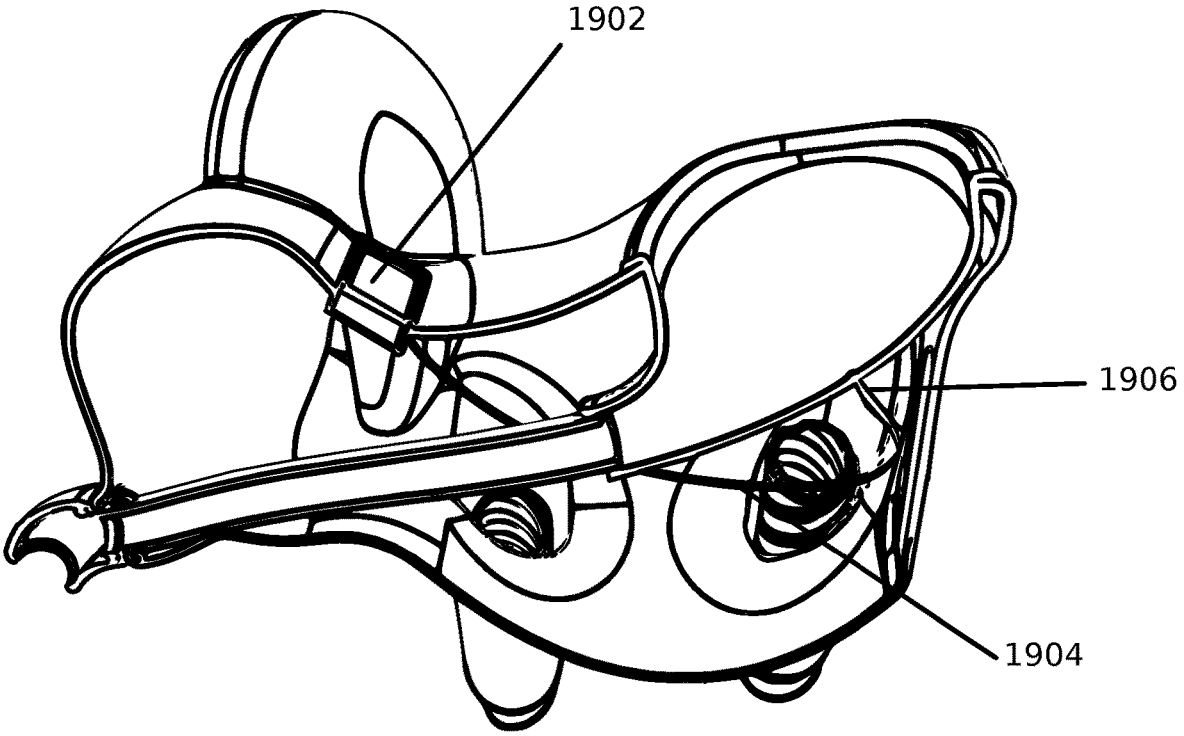
Figure 20:
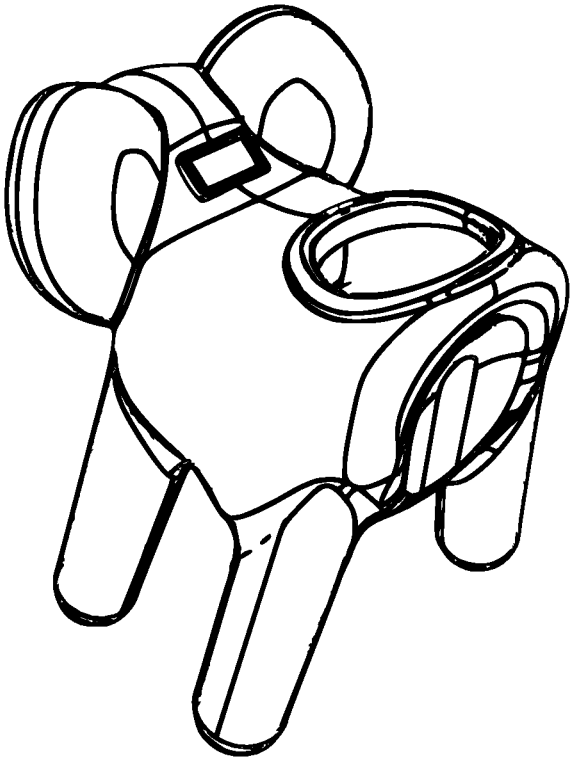

Referring to FIGS. 19-20, the device 100 may include a temperature sensor with display at the top of the body 102, as shown. The temperature sensor may include a probe 1904 with a lead 1906 that provides temperature information to the display 1902. The display may provide a numerical/digital or analogue (red, green, etc.) output.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A device for bathing children, comprising:

a hollow body having a proximal end and a distal end opposite the proximal end;

a plurality of height adjustable legs extending outward from the body;

a funnel shaped insert in the hollow body at the distal end thereof, the funnel shaped insert having an opening to receive a vertical flow of a water and an exit extending outward from a bottom of the funnel shaped insert in an orientation that redirects the vertical flow of the water;

a tubular channel disposed within the hollow body and coupled at a first end to the exit of the funnel shaped insert and extending toward the proximal end of the hollow body; and a spout rotatably coupled to the tubular channel at a proximal end opposite the first end.

2. The device of claim 1, wherein the body has a shape resembling anatomical features of an animal.

3. The device of claim 1, wherein the spout is rotatable 360-degree relative to the hollow body.

4. The device of claim 1, wherein the spout has a bend therein.

5. The device of claim 1, wherein at least one of the plurality of height adjustable legs comprises an elongated threaded leg extension having helical threading on an external surface thereof.

6. The device of claim 5, wherein at least one of the plurality of height adjustable legs comprises a tubular holder having helical threads corresponding to the helical threads of the elongated threaded leg extension on an interior surface of the tubular holder, and wherein the tubular holder is fixedly coupled to the hollow body, the at least one of the plurality of height adjustable legs adjustable by rotating the elongated threaded leg extension relative to the tubular holder.

7. The device of claim 5, wherein the at least one of the plurality of height adjustable legs comprises a suction cup pivotally coupled to the elongated threaded leg extension.

8. The device of claim 5, wherein the elongated threaded leg extension has incremental markings at a bottom thereof to display a water level from a bottom of the adjustable leg.

9. The device of claim 8, wherein the at least one of the plurality of height adjustable legs is other than plumb and wherein the incremental markings are at an angle.

10. The device of claim 9, wherein the markings are at an angle between 25° and 60°.

11. The device of claim 1, wherein the tubular channel is disposed horizontally within the hollow body.

12. The device of claim 1, wherein the tubular channel disposed within the hollow body to have a slope between 1.5% and 12.5%.

13. The device of claim 1, wherein the tubular channel disposed within the hollow body has a length of 14" to 17".

14. The device of claim 1, wherein a linear slope from a top of the funnel shaped insert to the spout is between 14.6% and 25.6%.

15. The device of claim 1, comprising a plurality of front leg and wherein the plurality of front legs are splayed laterally to provide a footwell providing clearance of between 4.5" and 11".

16. The device of claim 1, comprising a plurality of articulating rear legs.

17. The device of claim 16, wherein the articulating legs comprise at least one spherical joint with a rail thereon and a leg portion with a slotted spherical socket that receives the spherical joint in a pivoting relationship.

18. A device for bathing children, comprising:

a hollow body having a proximal end and a distal end opposite the proximal end;

a plurality of height adjustable legs extending outward from the body, including at least a plurality of front legs, wherein each of the plurality of height adjustable legs comprise:

an elongated threaded leg extension having helical threading on an external surface thereof, a tubular holder having helical threads corresponding to the helical threads of the elongated threaded leg extension on an interior surface of the tubular holder, wherein the tubular holder is fixedly coupled to the hollow body, the at least one of the plurality of height adjustable legs adjustable by rotating the elongated threaded leg extension relative to the tubular holder, and wherein a plurality of front legs are splayed laterally to provide a footwell providing clearance of between 4.5" and 11", and a suction cup pivotally coupled to the elongated threaded leg extension;

a funnel shaped insert in the hollow body at the distal end thereof, the funnel shaped insert having an opening to receive a vertical flow of a water and an exit extending outward from a bottom of the funnel shaped insert in an orientation that redirects the vertical flow of the water;

a tubular channel disposed within the hollow body and coupled at a first end to the exit of the funnel shaped insert and extending toward the proximal end of the hollow body, wherein the tubular channel has a slope between 1.5% and 12.5% and a length of 14" to 17"; and a spout rotatably coupled to the tubular channel at a proximal end opposite the first end.

19. The device of claim 18, wherein the elongated threaded leg extension has incremental markings at a bottom thereof to display a water level from a bottom of the adjustable leg.

20. The device of claim 1, wherein a linear slope from a top of the funnel shaped insert to the spout is between 14.6% and 25.6%.

* * * * *